US010912395B2

(12) United States Patent
Bausch

(10) Patent No.: US 10,912,395 B2
(45) Date of Patent: Feb. 9, 2021

(54) BABY RECLINER

(71) Applicant: Adam Lawrence Bausch, San Diego, CA (US)

(72) Inventor: Adam Lawrence Bausch, San Diego, CA (US)

( * ) Notice: Subject to any disclaimer, the term of this patent is extended or adjusted under 35 U.S.C. 154(b) by 227 days.

(21) Appl. No.: 16/107,148

(22) Filed: Aug. 21, 2018

(65) Prior Publication Data

US 2019/0053639 A1 Feb. 21, 2019

Related U.S. Application Data

(60) Provisional application No. 62/548,076, filed on Aug. 21, 2017.

(51) Int. Cl.
*A47D 15/00* (2006.01)
*A47D 9/00* (2006.01)
*A47D 7/00* (2006.01)

(52) U.S. Cl.
CPC ..... *A47D 15/003* (2013.01); *A47D 9/005* (2013.01); *A47D 7/002* (2013.01)

(58) Field of Classification Search
CPC ..... A47D 15/003; A47D 9/005; A47D 7/002; A47C 27/001
See application file for complete search history.

(56) References Cited

U.S. PATENT DOCUMENTS 3,400,413 A 9/1968 La
D282,427 S 2/1986 O'Sullivan
4,689,844 A * 9/1987 Alivizatos ..... A47C 27/086 297/452.16
D338,110 S 8/1993 Peay
5,279,237 A * 1/1994 Alivizatos ..... A47K 3/001 112/475.05
5,708,998 A 1/1998 Torbik
D392,497 S 3/1998 Mansfield
6,233,767 B1 * 5/2001 Horowitz ..... A47D 13/08 5/490
D593,351 S 6/2009 Song
D612,547 S 3/2010 Zine
D614,816 S 4/2010 Zine
D622,087 S 8/2010 Carr et al.
D661,844 S 6/2012 Song
D664,303 S 7/2012 Chauncey et al.
D673,789 S 1/2013 Furuland
D673,790 S 1/2013 Furuland
D674,644 S 1/2013 Stewart
D699,483 S 2/2014 Berg
D731,209 S 6/2015 Fux
D756,138 S 5/2016 Bonnema
D769,026 S 10/2016 Weiss et al.
D779,856 S 2/2017 Rich et al.
(Continued)

*Primary Examiner* — David R Hare
*Assistant Examiner* — Adam C Ortiz
(74) *Attorney, Agent, or Firm* — John L. Rogitz

(57) ABSTRACT

A baby recliner has two cushions separated from each other by a seam along which one cushion can be folded back against the other cushion to establish a cushion stack. The top cushion is formed with a baby channel defined by seams, with lateral support sections being established outboard of the seams defining the channel. A baby can be placed in the baby channel with his or her head on the cushion stack elevated above the legs which extend down the slightly slanted channel.

19 Claims, 7 Drawing Sheets

(56) References Cited

U.S. PATENT DOCUMENTS

| | | | |
|---|---|---|---|
| D809,715 | S | 2/2018 | Song |
| D814,824 | S | 4/2018 | Furuland |
| D822,911 | S | 7/2018 | Menayan et al. |
| D828,700 | S | 9/2018 | Jhunjhnuwala |
| D833,687 | S | 11/2018 | Song |
| D836,849 | S | 12/2018 | Romaya |
| 10,163,321 | B2 | 12/2018 | Furuland |

* cited by examiner

BABY RECLINER

FIELD

This application relates to baby recliners.

BACKGROUND

A need exists for comfortable recliners for babies both for resting a child and to assist in supporting the child during feeding when, for example, a mother might have more than one baby to feed.

SUMMARY

A baby recliner includes an elongated rectilinear body defining a length, a width shorter than the length, a long dimension, left and right peripheries extending the length of the body in the long dimension, a transverse dimension perpendicular to the long dimension, a baby rest surface, and a bottom surface opposed to the baby rest surface. Both surfaces extend the length and width of the body from a foot end of the body to a head end of the body opposed to the foot end in the long dimension. In turn, the body includes a top cushion stuffed with cushioning material and extending from the head end of the body toward the foot end, along with a recliner cushion stuffed with cushioning material. The recliner cushion is formed with a rectilinear channel transversely inboard of the left and right edges with left and right-side support regions established between the channel and the respective left and right edges. The channel defines a first thickness, and the side support regions define a second thickness thicker than the first thickness. A seam extends transversely across the body in the transverse dimension and connects the top cushion and the recliner cushion. With this structure, the top cushion is foldable relative to the recliner cushion along the seam such that the top cushion can be folded back against the recliner cushion with the top surface of the top cushion facing down to rest on a surface with the top surface of the recliner cushion facing up to receive a baby in the channel with the top cushion positioned below both the baby's head and the recliner cushion. The bottom surfaces of the two cushions thus are against each other in this folded configuration.

In some implementations, edges of the channel may be defined by seams. In these implementations, the baby rest surface may be established by a top cover and the bottom surface may be defined by a bottom cover, and the seams defining the edges of the channel sew together the top cover and the bottom cover.

The body may include cotton and/or hypoallergenic outer cover. The baby rest surface can be established by a top cover and the bottom surface can be defined by a bottom cover. Along these lines, the seam extending transversely across the body in the transverse dimension and connecting the top cushion and the recliner cushion sews together the top cover and the bottom cover.

In another aspect, an apparatus includes body defining a length, a width, a long dimension, left and right peripheries extending the length of the body in the long dimension, a transverse dimension perpendicular to the long dimension, a baby rest surface, and a bottom surface opposed to the baby rest surface. Both surfaces extend from a foot end of the body to a head end of the body opposed to the foot end in the long dimension. The body in turn includes a top cushion stuffed with cushioning material and extending from the head end of the body toward the foot end, and a recliner cushion also stuffed with cushioning material. The recliner cushion is formed with a channel defining channel edges that are transversely inboard of the left and right edges of the body with left and right-side support regions established between the edges of the channel and the left and right edges of the body. A seam extends transversely across the body in the transverse dimension and connects the top cushion and the recliner cushion. With this cooperation of structure, the top cushion is foldable relative to the recliner cushion along the seam such that the top cushion can be folded back against the recliner cushion with the top surface of the top cushion facing down to rest on a surface with the top surface of the recliner cushion facing up to receive a baby in the channel.

In another aspect, an apparatus includes a body defining a length, a width, a first dimension, left and right peripheries extending the length of the body in the first dimension, a transverse dimension perpendicular to the first dimension, a baby rest surface, and a bottom surface opposed to the baby rest surface. Both surfaces extend from a foot end of the body to a head end of the body opposed to the foot end in the first dimension. The width may equal the length or may not equal the length. For example, the width may be less than the length. The body in turn includes a top cushion stuffed with cushioning material and extending from the head end of the body toward the foot end. A recliner cushion is stuffed with cushioning material, with the recliner cushion being formed with a channel defining channel edges that are transversely inboard of the left and right edges of the body with left and right-side support regions established between the edges of the channel and the left and right edges of the body. A seam extends transversely across the body in the transverse dimension and connects the top cushion and the recliner cushion. The top cushion is foldable relative to the recliner cushion along the seam such that the top cushion can be folded back against the recliner cushion with the top surface of the top cushion facing down to rest on a surface, with the bottom surface of the top cushion against the bottom surface of the recliner cushion.

In another aspect, a baby recliner has first and second cushions separated from each other by a seam along which one cushion can be folded back against the other cushion to establish a cushion stack, with one of the first or second cushions defining a top cushion in the cushion stack. The top cushion is formed with a baby channel defined by seams, with lateral support sections being established outboard of the seams defining the baby channel and with the baby channel slanting at an oblique angle relative to horizontal when the cushions are arranged in the cushion stack. A child can be placed in the baby channel with his or her head on the cushion stack elevated above the child's legs, which extend down the baby channel slanting at an oblique angle relative to horizontal.

The details of the present application, both as to its structure and operation, can best be understood in reference to the accompanying drawings, in which like reference numerals refer to like parts, and in which:

DETAILED DESCRIPTION

Figure 1:
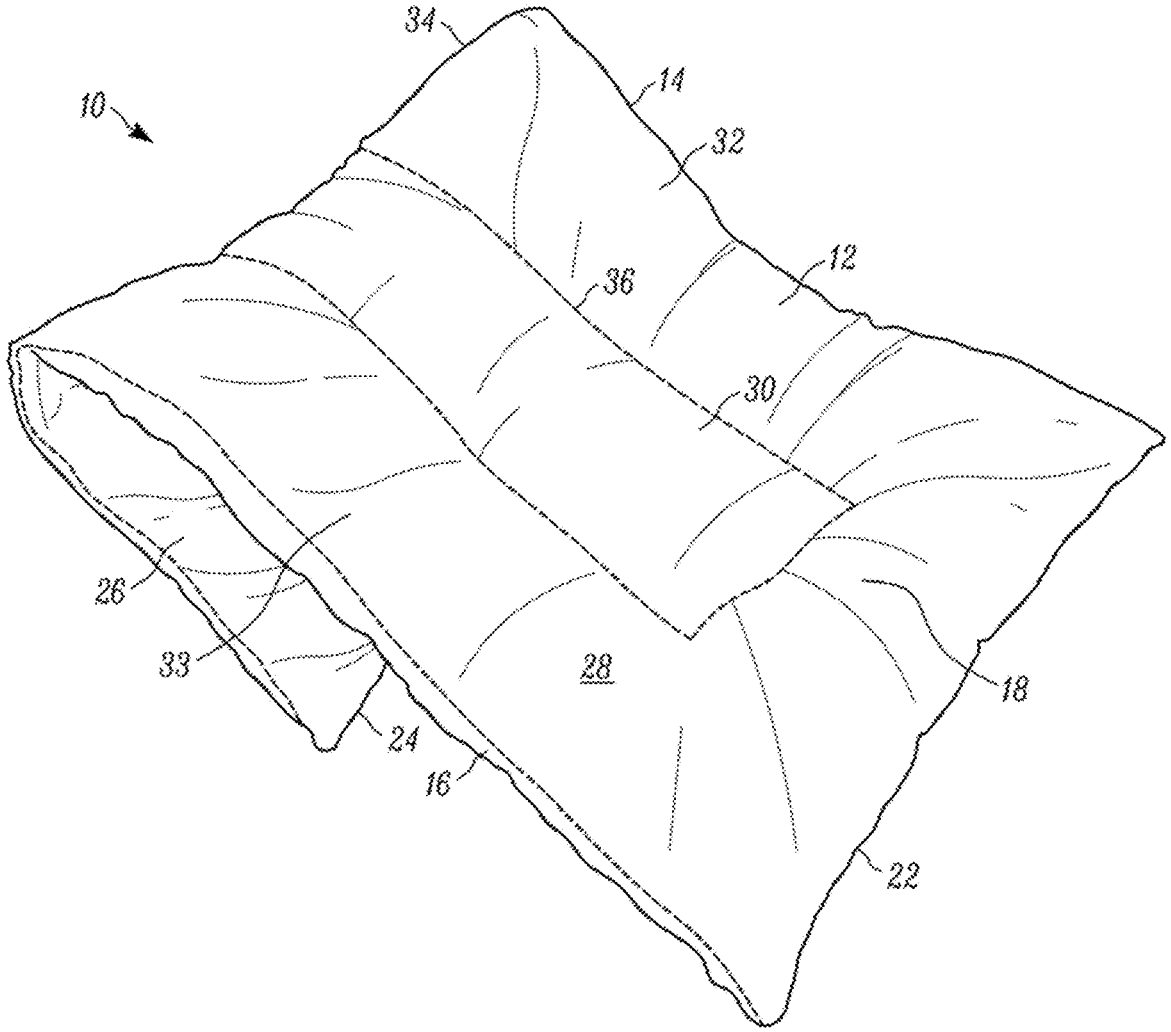
FIG. 1 is a perspective view of an embodiment of the baby recliner in the folded configuration.
Figure 2:
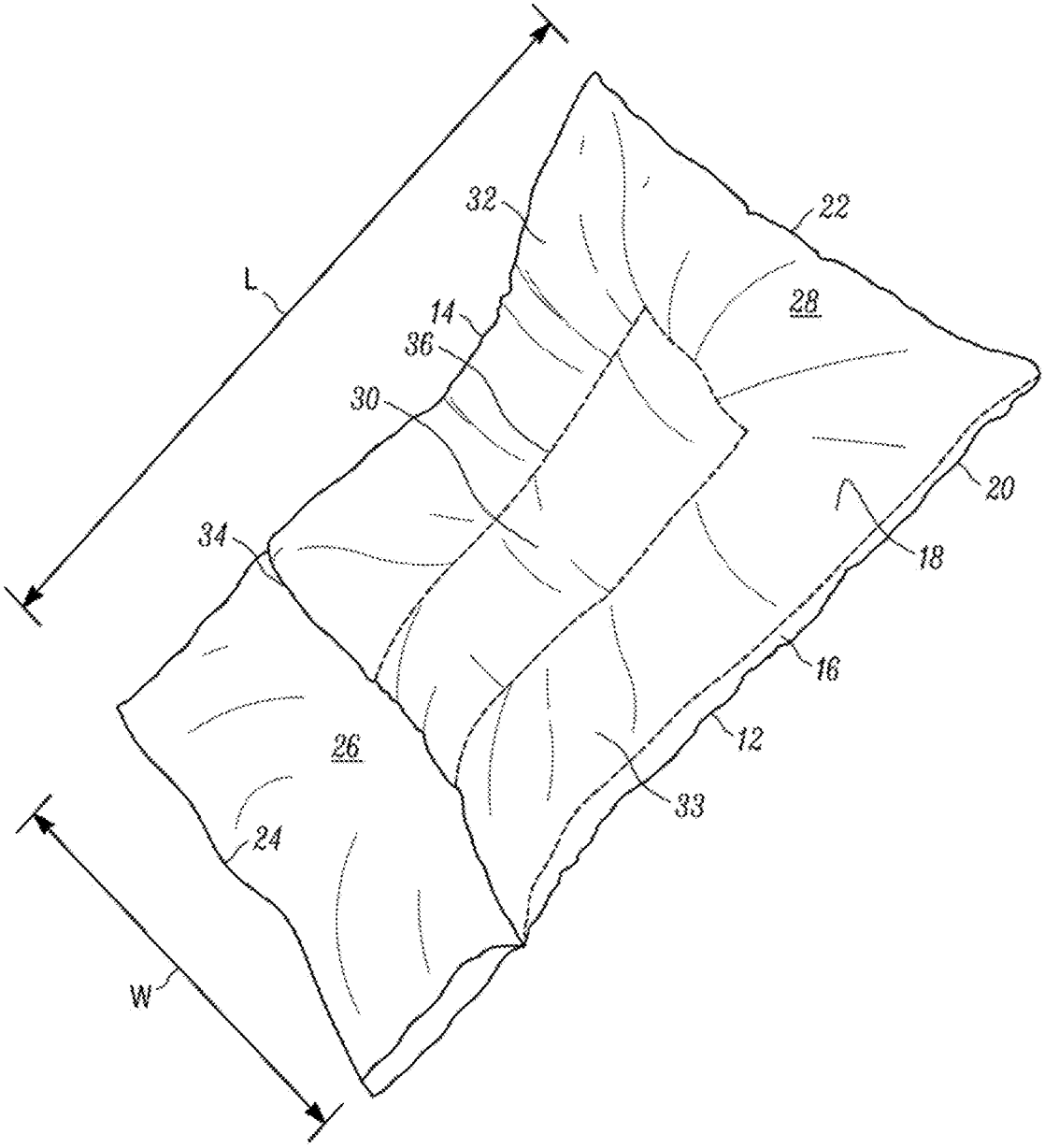
FIG. 2 is a perspective view of the embodiment of FIG. 1 in the unfolded configuration.
Figure 7:
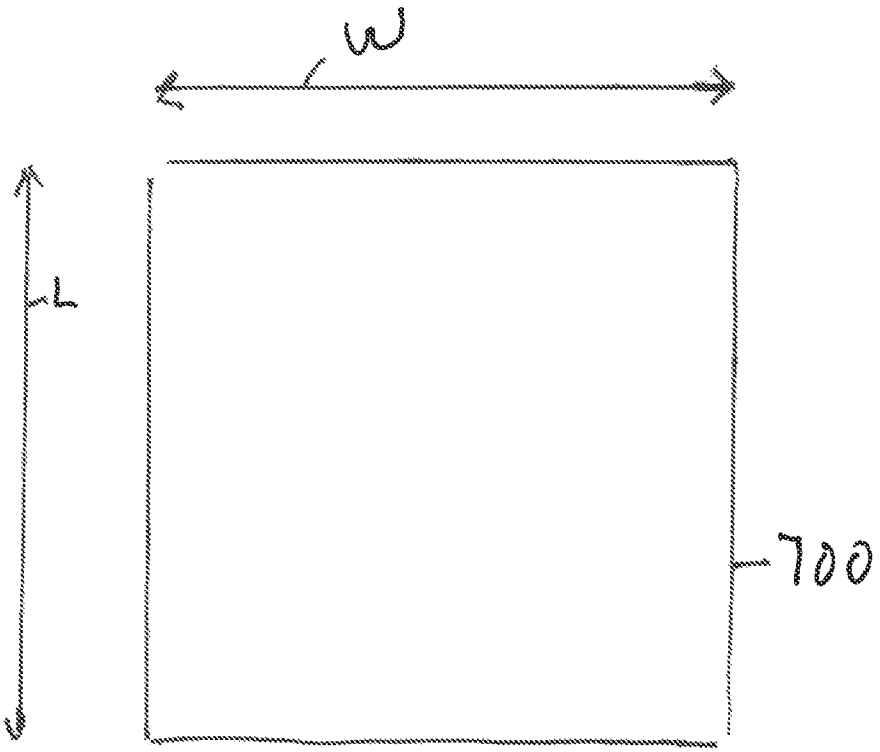
FIG. 7 is a top plan view of an alternate embodiment.

Referring initially to FIGS. 1 and 2, a baby recliner 10 includes an elongated rectilinear body 12 defining a length "L" (FIG. 2), a width "W" shorter than the length, a long dimension defined by the length, and left and right peripheries 14, 16 extending the length of the body in the long dimension. A transverse dimension is perpendicular to the long dimension in the direction of the width. FIG. 7 shows an alternate embodiment 700 in which the width "W" equals the length "L".

Figure 3:
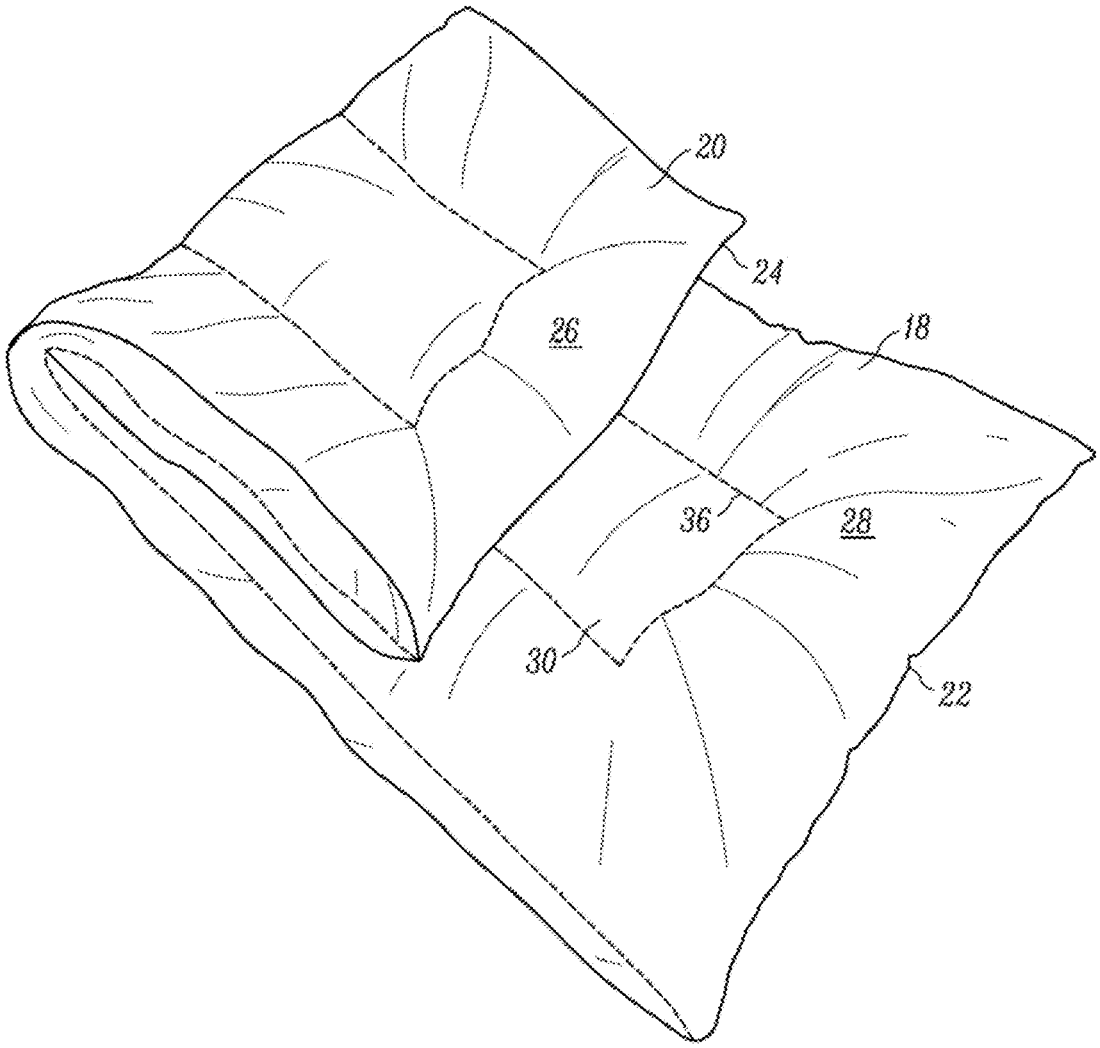
FIG. 3 is a perspective view from the bottom of the recliner in the folded configuration, showing that if desired, in an embodiment, the channel seams may extend through the top cushion.
Figure 4:
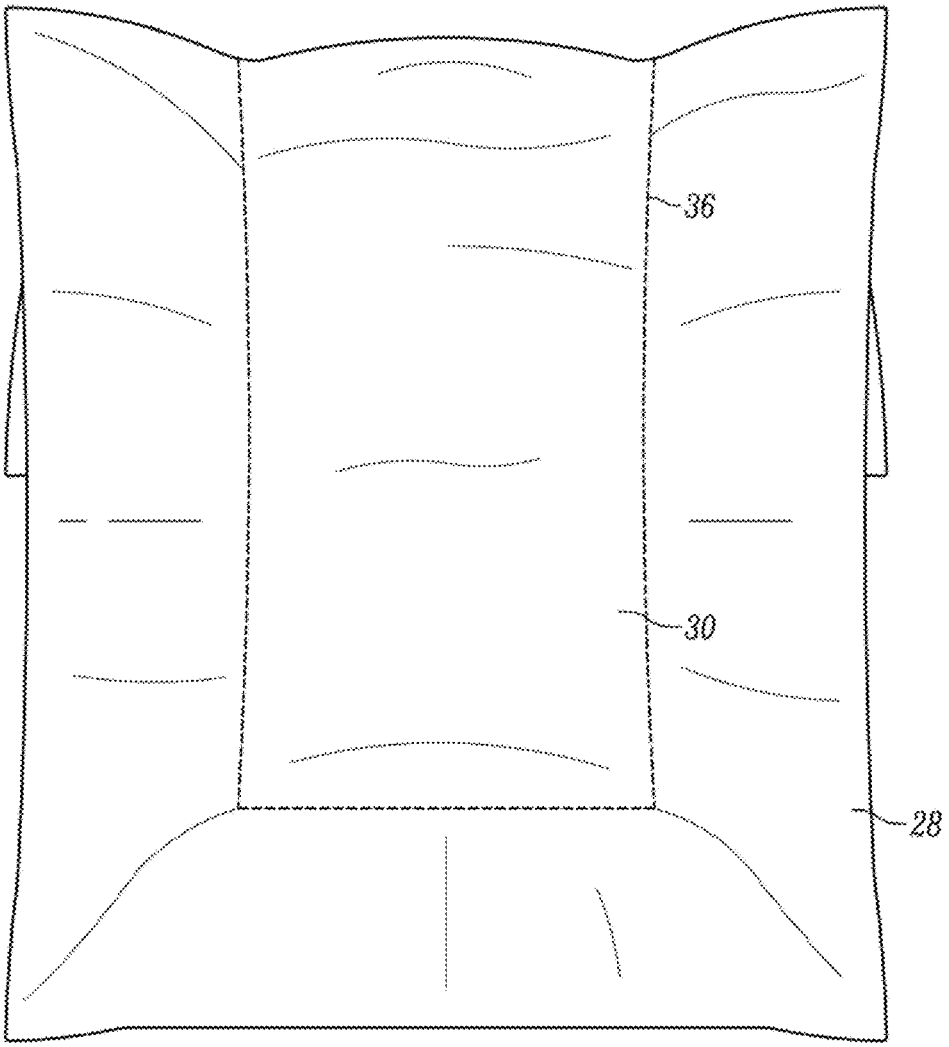
FIG. 4 is a top plan view of the embodiment of FIG. 1.
Figure 5:
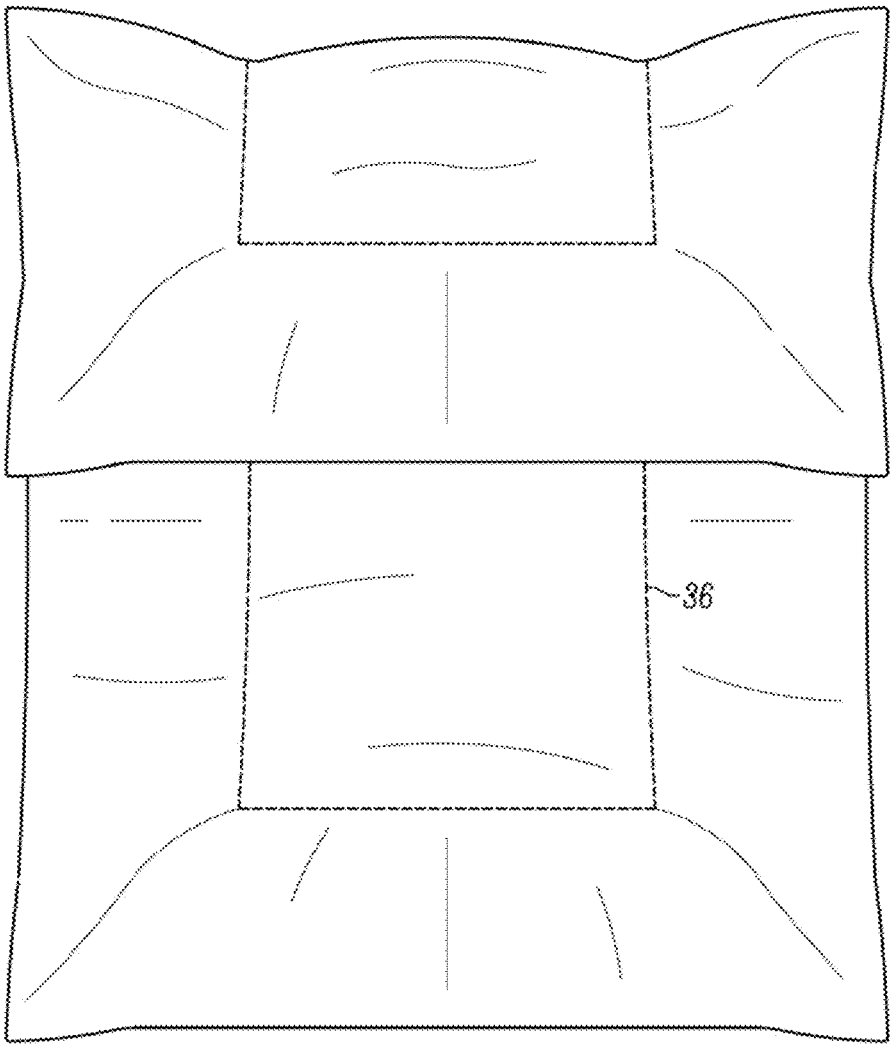
FIG. 5 is a bottom plan view of the embodiment of FIG. 1 showing that if desired, in an embodiment, the channel seams may extend through the top cushion.
Figure 6:
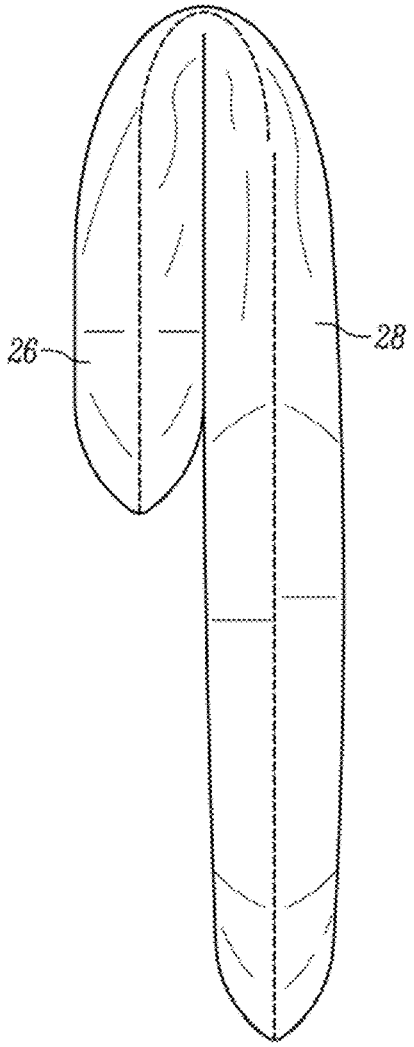
FIG. 6 is a side view of the embodiment of FIG. 1.

As shown best in FIG. 3, the body 12 includes a baby rest surface 18 and opposite to that a bottom surface 20. Both surfaces 18, 20 extend the length and width of the body from a foot end 22 of the body to a head end 24 of the body opposed to the foot end in the long dimension.

The body 12 includes a top cushion 26 that is stuffed with cushioning material and that extends from the head end 24 of the body 12 toward the foot end 22. The body 12 further includes a recliner cushion 28 that is stuffed with cushioning material. Cushioning material may be, e.g., down or other pillow stuffing or filler such as but not limited to foam rubber, polyester, cotton batting, etc. To contain the cushioning material, the baby rest surface 18 can be established by a top cover as shown and the bottom surface 20 can be defined by a bottom cover, with the covers being a single integrated piece of cotton and/or hypoallergenic material if desired.

The recliner cushion 28 is formed with a central, preferably elongated channel 30 that may be shaped as a rectangle as shown or that may assume other shapes such as a racetrack shape or ovular shape. The channel 30 is transversely inboard of the left and right edges 14, 16 with left and right-side support regions 32, 33 being established between the channel 30 and the respective left and right edges 14, 16.

As may be appreciated in reference to FIG. 1, the channel defines 30 a first thickness (i.e., in the dimension perpendicular to both the length and the width), and the side support regions 32, 33 define a second thickness thicker than the first thickness.

To demarcate the cushions 26, 28, a head seam 34 extends transversely across the body 12 in the transverse dimension and connects the top cushion 26 and the recliner cushion 28. With this structure, the top cushion 26 is foldable relative to the recliner cushion 28 along the head seam 34 such that the top cushion can be folded back against the recliner cushion as shown in FIGS. 1, 3, 4, 5, and 6 with the top surface of the top cushion facing down to rest on a surface with the top surface of the recliner cushion facing up to receive a baby in the channel. In this configuration, the top cushion 26 is positioned below both the baby's head and the recliner cushion 28. The bottom surfaces 20 of the two cushions thus are against each other in this folded configuration. Along these lines, the head seam 34 extending transversely across the body 12 in the transverse dimension and connecting the top cushion 26 and the recliner cushion 28 sews together the top cover and the bottom cover.

In some implementations, the edges of the channel 30 also may be defined by channel seams 36. In these implementations, the channel seams 36 define the edges of the channel 30 and sew together the top cover and the bottom cover. In the example shown in FIG. 2, the channel seams 36 extend to, but not past, the head seam 34 and thus do not extend into the top cushion 26. In an alternate example (FIG. 3, for instance), the channel seams 36 extend past the head seam 34 into the top cushion 26.

Thus, a baby recliner has two cushions 26, 28 separated from each other by a head seam 34 along which one cushion 26 can be folded back against the other cushion 28 to establish a cushion stack. The upper cushion (28) is formed with a baby channel 30 defined by channel seams 36, with lateral support sections 32 being established outboard of the seams 36 defining the channel. A baby can be placed in the baby channel with his or her head on the cushion stack elevated above the legs which extend down the channel 30, which is slanted slightly downwardly from the head seam 34 toward the foot end 22 as shown in the folded configuration owing to the propping effect of the top cushion 26 below the recliner cushion 28.

While the particular baby recliner is herein shown and described in detail, it is to be understood that the subject matter which is encompassed by the present invention is limited only by the claims.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

What is claimed is:

1. A baby recliner, comprising:

an elongated rectilinear body defining a length, a width shorter than the length, a long dimension, left and right peripheries extending the length of the body in the long dimension, a transverse dimension perpendicular to the long dimension, a baby rest surface, and a bottom surface opposed to the baby rest surface, both surfaces extending the length and width of the body from a foot end of the body to a head end of the body opposed to the foot end in the long dimension, the body comprising:

a top cushion stuffed with cushioning material and extending from the head end of the body toward the foot end;

a recliner cushion stuffed with cushioning material, the recliner cushion being formed with a rectilinear channel transversely inboard of the left and right edges with left and right-side support regions established between the channel and the respective left and right edges, the channel defining a first thickness and the channel being stuffed with the cushioning material in addition to the recliner cushion being stuffed with the cushioning material, the side support regions defining a second thickness thicker than the first thickness;

a seam extending transversely across the body in the transverse dimension and connecting the top cushion and the recliner cushion;

wherein the top cushion is foldable relative to the recliner cushion along the seam such that the top cushion can be folded back against the recliner cushion with the top surface of the top cushion facing down to rest on a surface with the top surface of the recliner cushion facing up to receive a baby in the channel with the top cushion positioned below both the baby's head and the recliner cushion.

2. The baby recliner of claim 1, wherein edges of the channel are defined by seams.

3. The baby recliner of claim 1, wherein the body comprises a hypoallergenic outer cover.

4. The baby recliner of claim 1, wherein the body comprises a cotton outer cover.

5. The baby recliner of claim 1, wherein the baby rest surface is established by a top cover and the bottom surface is defined by a bottom cover, and the seam extending transversely across the body in the transverse dimension and connecting the top cushion and the recliner cushion sews together the top cover and the bottom cover.

6. The baby recliner of claim 1, wherein the baby rest surface is established by a top cover and the bottom surface is defined by a bottom cover, and the seams defining the edges of the channel sew together the top cover and the bottom cover.

7. An apparatus, comprising:

a body defining a length, a width, a first dimension, left and right peripheries extending the length of the body in the first dimension, a transverse dimension perpendicular to the first dimension, a baby rest surface, and a bottom surface opposed to the baby rest surface, both surfaces extending from a foot end of the body to a head end of the body opposed to the foot end in the first dimension, the body comprising:

a top cushion stuffed with cushioning material and extending from the head end of the body toward the foot end;

a recliner cushion stuffed with cushioning material, the recliner cushion being formed with a channel defining channel edges that are transversely inboard of the left and right edges of the body with left and right-side support regions established between the edges of the channel and the left and right edges of the body, the channel being stuffed with the cushioning material between the channel edges;

a seam extending transversely across the body in the transverse dimension and connecting the top cushion and the recliner cushion;

wherein the top cushion is foldable relative to the recliner cushion along the seam such that the top cushion can be folded back against the recliner cushion with the top surface of the top cushion facing down to rest on a surface with the bottom surface of the top cushion against the bottom surface of the recliner cushion.

8. The apparatus of claim 7, wherein the length equals the width.

9. The apparatus of claim 7, wherein the length does not equal the width.

10. The apparatus of claim 8, wherein the body is rectilinear.

11. The apparatus of claim 8, wherein the channel defines a first thickness, the side support regions defining a second thickness thicker than the first thickness.

12. The apparatus of claim 8, wherein the edges of the channel are defined by seams, wherein the baby rest surface is established by a top cover and the bottom surface is defined by a bottom cover, and the seams defining the edges of the channel sews together the top cover and the bottom cover.

13. A baby recliner comprising:

first and second cushions separated from each other by a seam along which one cushion can be folded back against the other cushion to establish a cushion stack with one of the first or second cushions defining a top cushion in the cushion stack;

the top cushion being formed with a baby channel defined by seams and the top cushion and baby channel both being stuffed with cushion material, with lateral support sections being established outboard of the seams defining the baby channel and with the baby channel slanting at an oblique angle relative to horizontal when the cushions are arranged in the cushion stack, wherein a child can be placed in the baby channel with his or her head on the cushion stack elevated above the child's legs, which extend down the baby channel slanting at an oblique angle relative to horizontal.

14. The baby recliner of claim 13, wherein the cushions are rectilinear.

15. The baby recliner of claim 13, wherein the baby channel is rectilinear.

16. The baby recliner of claim 13, wherein the top cushion is longer than the first or second cushion arranged below the top cushion when the cushions are arranged in the cushion stack.

17. The baby recliner of claim 13, wherein the baby channel defines a first thickness, the lateral support regions defining a second thickness thicker than the first thickness.

18. The baby recliner of claim 13, wherein a top surface is established by the top cushion and a bottom surface is defined by the top cushion, and the seams sews together the top cover and the bottom cover.

19. The apparatus of claim 8, wherein the channel is ovular.

* * * * *